US005669826A

United States Patent [19]

Chang et al.

[11] Patent Number: 5,669,826

[45] Date of Patent: Sep. 23, 1997

[54] STRUCTURE OF GOLF CLUB HEAD

[75] Inventors: Poh-Heng Chang, Malim Jaya, Malaysia; Chung-Jong Sung, Tainan, Taiwan

[73] Assignee: Sung Ling Golf & Casting Co., Ltd., Tainan, Taiwan

[21] Appl. No.: 588,782

[22] Filed: Jan. 19, 1996

[51] Int. Cl.[6] ..... A63B 53/04

[52] U.S. Cl. ..... 473/332; 473/349; 473/350

[58] Field of Search ..... 473/334, 335, 473/337, 341, 345, 346, 347, 348, 349, 350, 332, 256, 291; 273/171, 172, 173, 167 F, 167 D

[56] References Cited

U.S. PATENT DOCUMENTS 4,027,885 6/1977 Rodgers ..... 473/342

4,826,172 5/1989 Antonious ..... 473/350

5,385,348 1/1995 Wargo ..... 473/338

5,492,327 2/1996 Biafore ..... 473/350

5,564,705 10/1996 Kobayashi ..... 473/334

*Primary Examiner*—Sebastiano Passaniti

*Assistant Examiner*—Stephen L. Blau

*Attorney, Agent, or Firm*—Varndell Legal Group

[57] ABSTRACT

A golf club head having a face of uniform thickness at the front side, a back hole at the back side, an upright flange raised around the back hole and defining with the periphery of the golf club head a groove around the back hole, and at least one counter weight element of uniform specific gravity fastened to the groove to eliminate resonance vibration.

7 Claims, 10 Drawing Sheets

STRUCTURE OF GOLF CLUB HEAD

BACKGROUND OF THE INVENTION

The present invention relates to golf club heads, and relates more particularly to an improved structure of golf club head which has a uniform perimeter weight and provides a broad sweet spot and, which effectively eliminates resonance vibration upon hitting.

The game of golf has become more and more popular in most countries of the world. While playing golf, different golf clubs shall be used in different conditions. For example, a wooden club set includes a driver, a brassie, a spoon, No. 4 wood, No. 5 wood, No. 6 wood, and No. 7 wood; an iron club set includes No. 1 iron/cleek, No. 2 iron/ midiron, No. 3 iron/mid-mashie, No. 4 iron/mashie iron, No. 5 iron/ mashie, No. 6 iron/spade iron, No. 7 iron/mashie niblick, No. 8 iron/pitching niblick, No. 9 iron/niblick, and No. 10 iron/wedge. Because the club heads of different numbers have different structures and are made by different molds, the manufacturing cost of the clubs cannot be greatly reduced. Although the structure of the head has a great concern with the quality of the golf club, one quality golf club head still cannot fit all players. Because regular golf club heads are made according to standard specifications, they can not be adjusted to fit different players. FIG. 1 shows a golf club head with a back hole. Because the perimeter weight of this structure of golf club head is not uniform, the user needs to spend a lot time in practicing the club in order to obtain a good hitting point at the face. However, because vibrating waves are transmitted from the club head through the shaft to the player's hands when hitting, the player's hands may be injured easily during playing. FIG. 2 shows a solid golf club head with a back hole according to the prior art in which the sweet spot is at a limit area within the solid structure of the face. It is difficult to control the flying direction of the ball by using this structure of golf club head, because the ball tends to deviate from the course if it is not hit at the right angle. It is well known that the center of gravity of the golf club head can be adjusted to fit individual's requirements by changing the location of the back hole (see FIG. 3). However, an adjustable golf club head must be specially designed and manufactured, therefore its manufacturing cost is high.

SUMMARY OF THE INVENTION

It is one object of the present invention to provide a golf club head which provides a broad sweet spot. It is another object of the present invention to provide a golf club head which effectively eliminates resonance vibration upon hitting. It is still another object of the present invention to provide a golf club head which can be conveniently adjusted to change the center of gravity. It is still another object of the present invention to provide a golf club head which is inexpensive to manufacture.

According to one aspect of the present invention, the golf club head comprises a face of uniform thickness at the front side, a back hole at the back side, an upright flange raised around the back hole and defining with the periphery of the golf club head a groove around the back hole, and at least one counter weight element of uniform specific gravity fastened to the groove to eliminate resonance vibration. According to another aspect of the present invention, two ribs of different thickness are made inside the back hole of the golf club head and defining with the periphery two counter weight chambers of different sizes respectively, and a plurality of counter weight elements are respectively fastened to the counter weight chambers to change the center of gravity of the golf club head.

DETAILED DESCRIPTION OF THE PREFERRED EMBODIMENT

Figure 1:
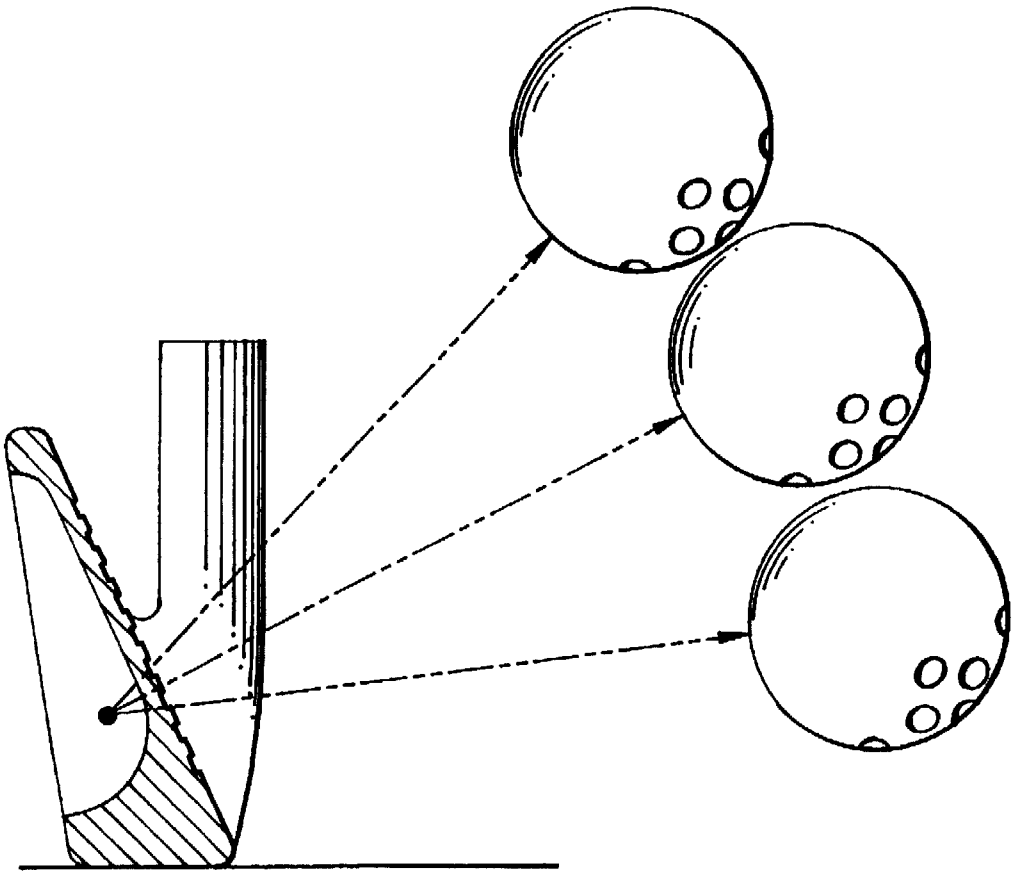
PRIOR ART Fig. 1
FIG. 1 is a sectional view of a golf club head according to the prior art.
Figure 2:
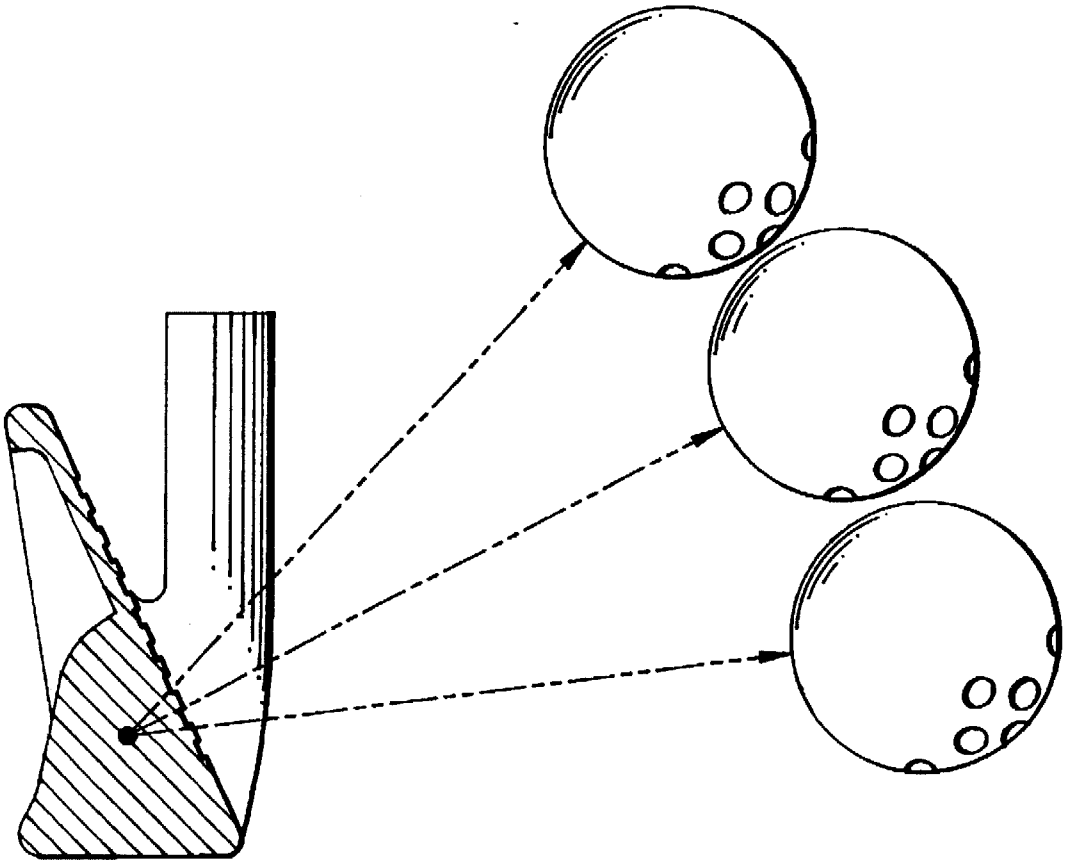
PRIOR ART Fig. 2
FIG. 2 is a sectional view of another structure of golf club head according to the prior art.
Figure 3:
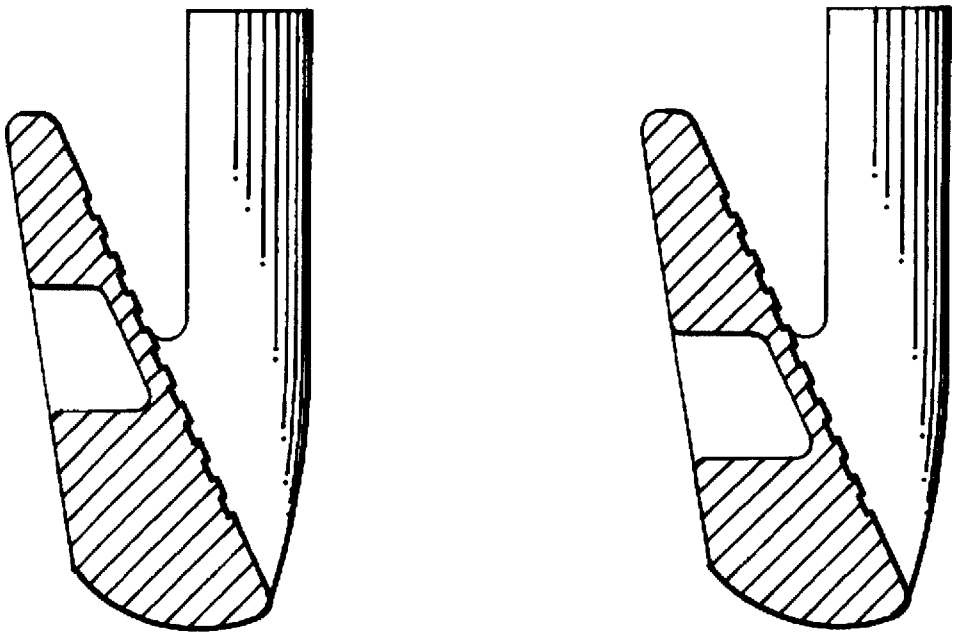
PRIOR ART Fig. 3
FIG. 3 shows different golf club heads with different back holes at different locations according to the prior art.
Figure 4:
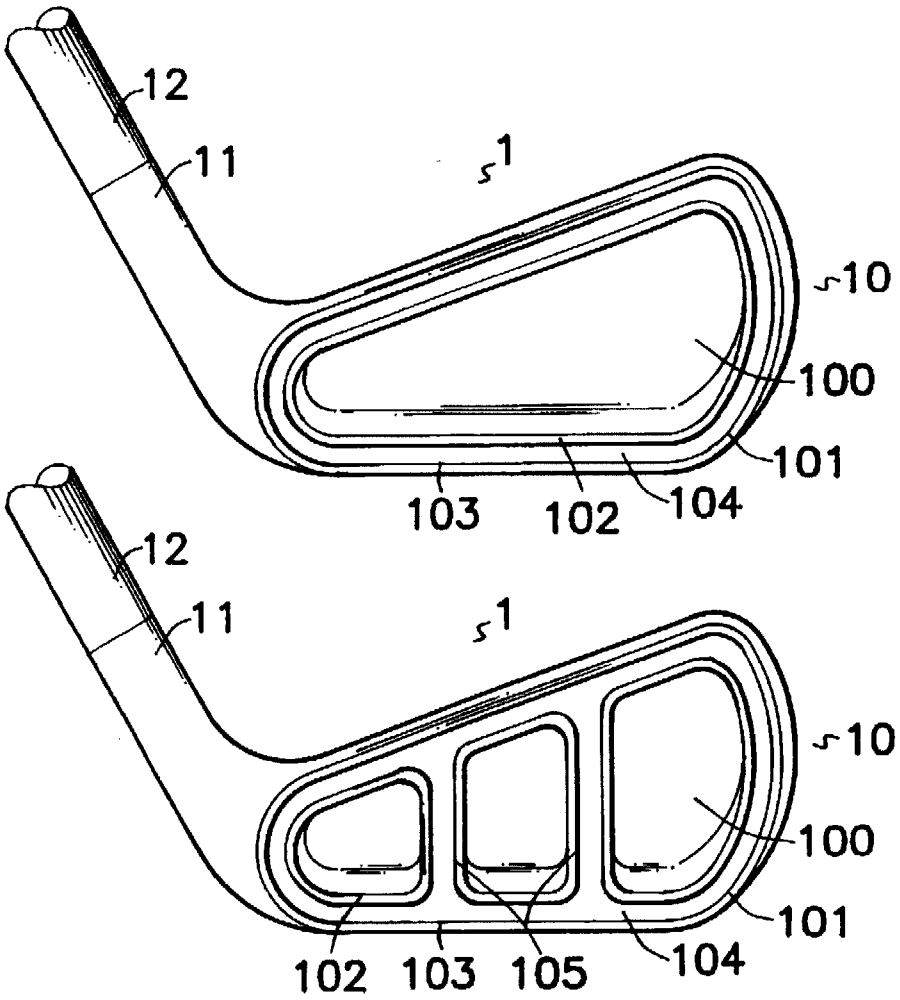
FIG. 4 shows the structure of the back side of the golf club head according to one embodiment of the present invention.
Figure 6:
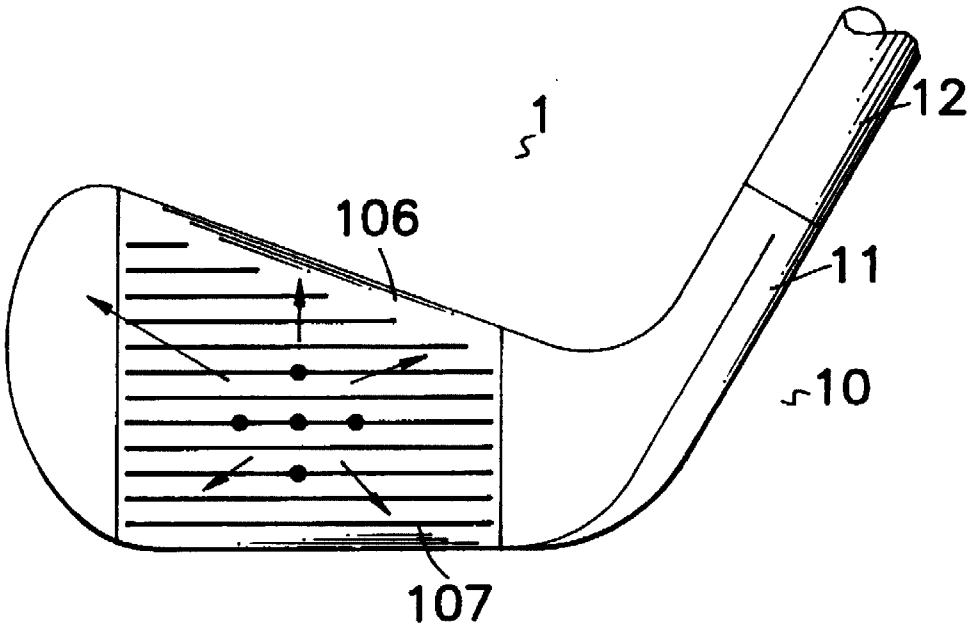
FIG. 6 is a front side view of the golf club head shown in FIG. 4, showing the distribution of impact force through the face.
Figure 5:
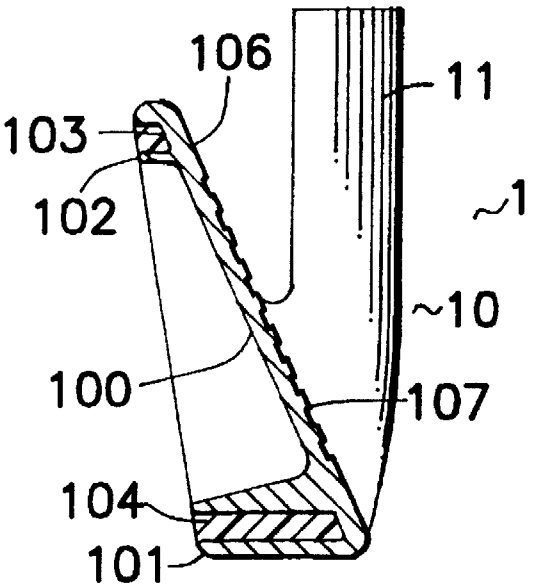
FIG. 5 is a sectional view of the golf club head shown in FIG. 4.

Referring to FIGS. 4 and 5, the gold club head, referenced by 1, comprises a casing 10, a neck 11 extending from one end of the casing 10 and connected to a shaft 12, a back hole 100 at the back side of the casing 10, an upright flange 102 raised around the back hole 100 and defining with the periphery 101 of the back side of the casing 10 a groove 103, shock absorbing means of uniform specific gravity 104 mounted within the groove 103, a face 106 of uniform thickness at the front side of the casing 10, two ribs 105 raised from the back side of the face 106 and spaced within the back hole 100, and a plurality of scoring lines 107 formed on the face 106. When the outwardly distributed impact force from the hitting point at the face 106 is transmitted to the upright flange 102 around the back hole 100 upon a hit (see also FIG. 6), vibrating waves are absorbed by the shock absorbing means 104 to eliminate the formation of resonance vibration. Therefore, the area of the sweet spot of the face 106 is relatively increased. The transverse ribs 105 may be grooved along the length and filled up with the aforesaid shock absorbing means of uniform specific gravity 104 to eliminate resonance vibration upon a hit. This arrangement ensures a uniform perimeter weight of the back hole 100 so as to increase the area of the sweet spot of the face 106. Because resonance vibration is suppressed, vibration waves are prohibited from transmitting to the player's hand.

Figure 7:
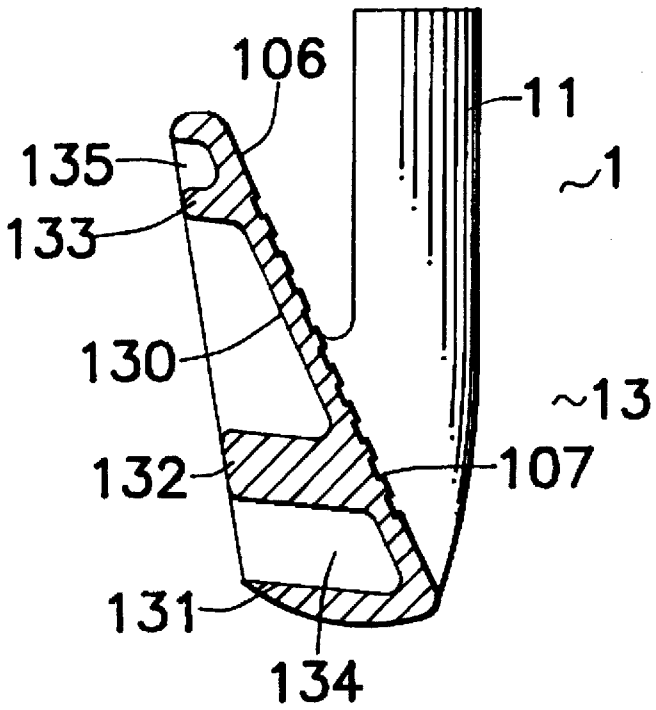
FIG. 7 is a sectional view of an alternate form of the golf club head according to the present invention, showing two counter weight chambers defined within the back side of the casing.
Figure 8:
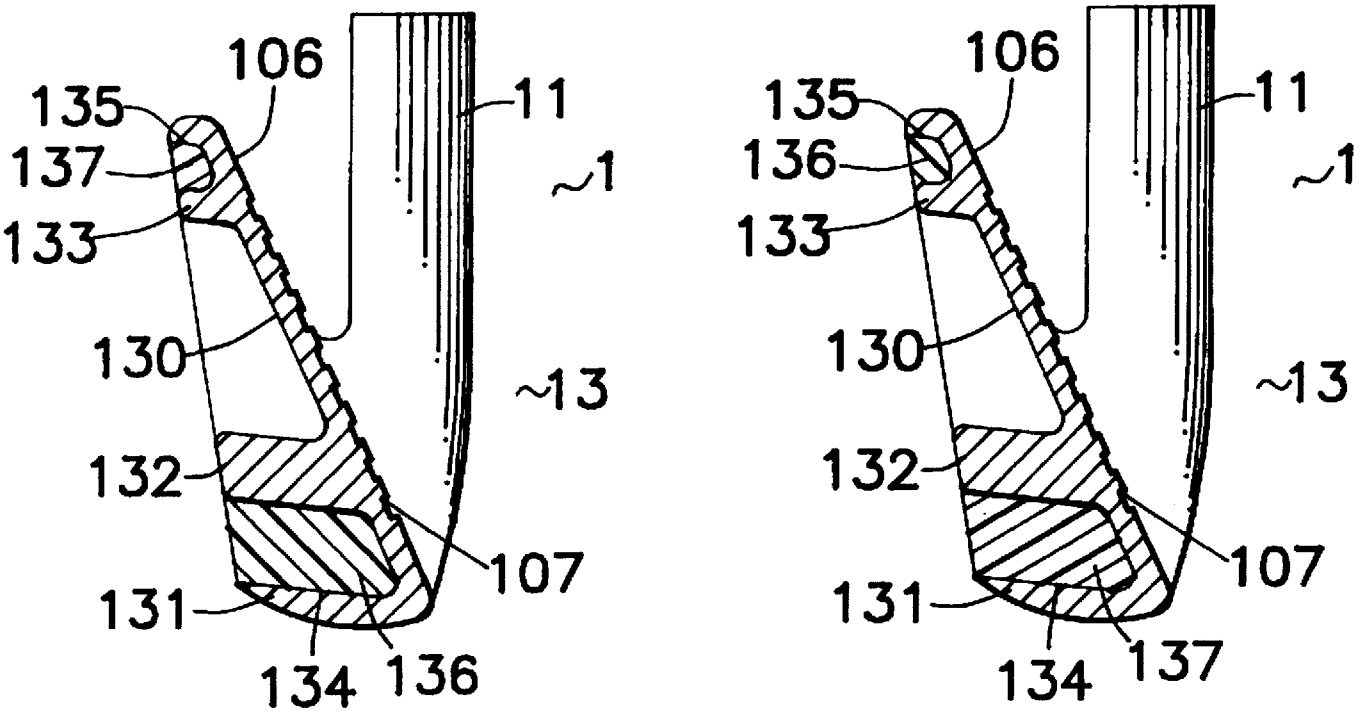
FIG. 8 shows different arrangement of counter weight elements in the counter weight chambers of the golf club head shown in FIG. 7.
Figure 9:
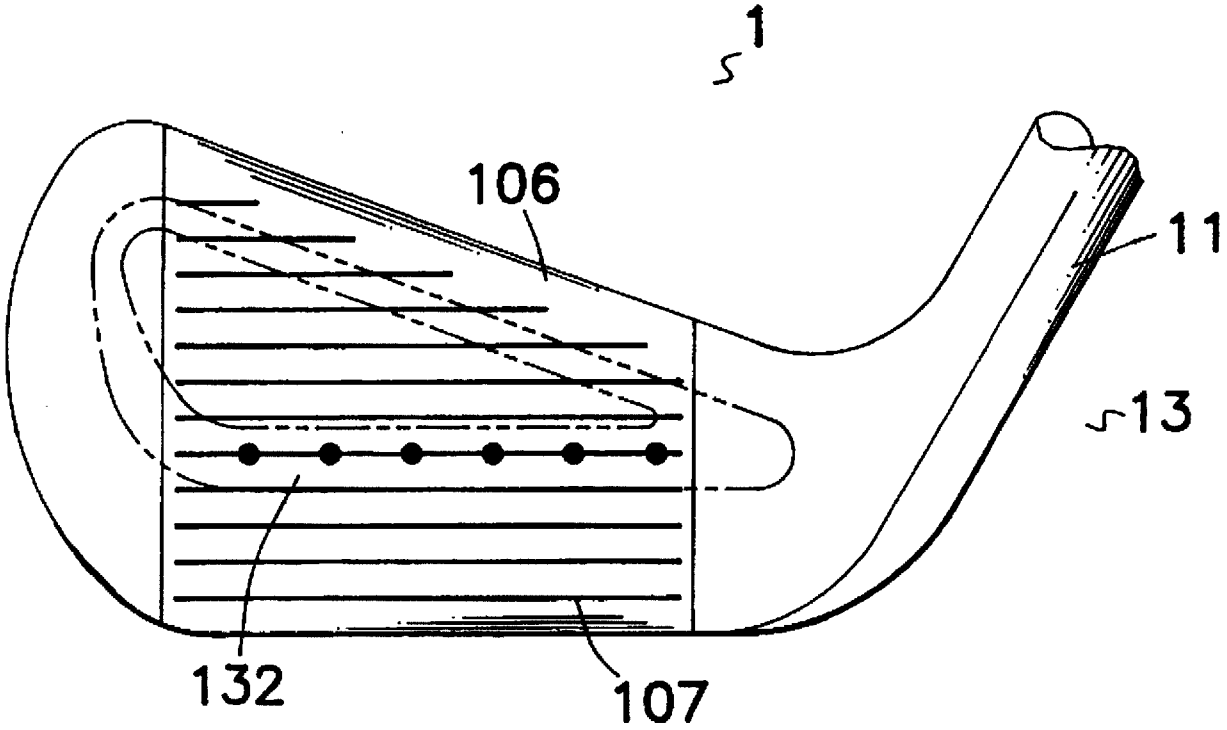
FIG. 9 is a schematic drawing showing the location of the center of gravity in the golf club head shown in FIG. 8.

The position of the center of gravity of the golf club head can be changed by adding counter weight means to different locations of the golf club head. As illustrated in FIGS. 7 and 8, the golf club head 1 is comprised of a casing 13 and a neck at one end of the casing 13. The casing 13 comprises a face 106 of uniform thickness at the front side made with scoring lines 107, a back hole 130 at the back side, two ribs 132 and 133 raised from the back side of the face 106 and spaced within the back hole 130 and defining with the periphery 131 of the casing 13 a big counter weight chamber 134 and a small counter weight chamber 135. The ribs 132 and 133 are of different thickness, i.e., the rib 132 is thicker than the rib 133. By fastening different counter weight elements 136 and 137 to the big counter weight chamber 134 and the small counter weight chamber 135, the center of gravity of the golf club head 1 can be adjusted to a longitudinal line at the face 106 corresponding to the thick rib 132 (see also FIG. 9).

Figure 10:
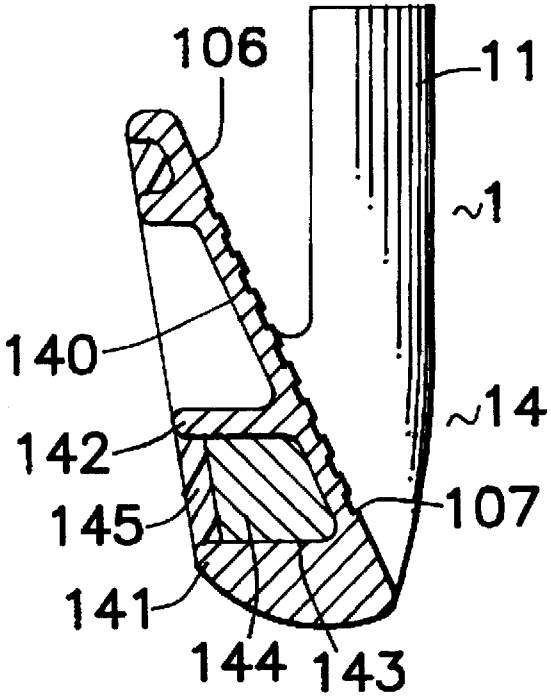
FIG. 10 is a sectional view of another alternate form of the golf club head according to the present invention.
Figure 11:
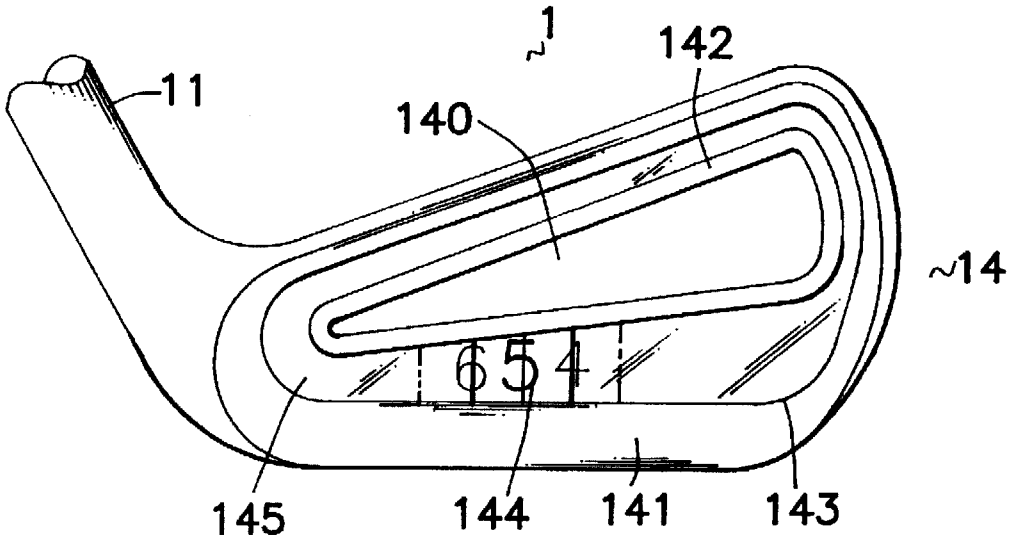
FIG. 11 is a back side view of the golf club head shown in FIG. 10.
Figure 12:
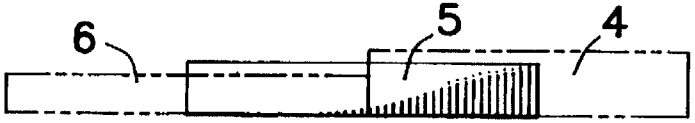
FIG. 12 shows the arrangement of a plurality of counter weight elements overlapped with one another according to the present invention.

Referring to FIGS. 10 and 11, the golf club head 1 comprises a casing 14 and a neck 11 at one end of the casing 14. The casing 14 comprises a face 106 at the front side made with scoring lines 107, a back hole 140 at the back side, an upright flange 142 raised around the back hole 140 and defining with the periphery 141 of the casing 14 a groove 143. The width of the groove 143 reduces gradually from the bottom toward the top, i.e., the groove 143 is made gradually wider from the top toward the bottom. A plurality of counter weight elements 144 of same weight but of different shapes may be fastened to the groove 143. By changing the number of counter weight elements 144, the center of gravity of the golf club head 1 is adjusted. When the counter weight elements 144 are installed, the groove 143 is filled up with resin or rubber 145 and covered partially over the counter weight elements 144 to secure them in place and to let the code number of the designated golf club head which is made on the counter weight elements 144 be seen from the outside. The counter weight elements 144 are made of different shapes (different lengths and thickness) so that they can be fastened to the groove 143 at different locations and overlapped with one another see, for example, counter weights 4,5, and 6 in FIG. 12). When a plurality of counter weight elements 144 are fastened to the groove 143, the two opposite ends of an intermediate counter weight element are respectively disposed at the center of the front counter weight element and the center of the rear counter weight element.

As indicated, the present invention provides a golf club head which has a face of uniform thickness, a groove and/or counter weight chambers at the back side around or within a back hole thereof, and shock absorbing or counter weight means fastened to the groove and/or the counter weight chambers to eliminate resonance vibration and/or to change the center of gravity to the desired location.

We claim:

1. A golf club head comprising a front, a back, a top, a bottom, a toe and a heel, said front having a club face with a uniform thickness and a periphery, said back including a peripheral wall extending backward from said periphery of said front at an angle; said peripheral wall extending about said top, said bottom, said toe and said heel; said back additionally including an upright flange extending backward at said angle and forming a continuous groove with said peripheral wall, said back further including a cavity formed by said upright flange and two ribs including transverse grooves extending from said top to said bottom and communicating with said continuous groove; said club face, said peripheral wall and said flange are integrally formed; and a counter weight element is secured in said continuous groove.

2. The golf club head of claim 1, wherein said groove has a uniform width and said counter weight element is made of uniform specific gravity material that absorbs resonance vibration.

3. The golf club head of claim 1, wherein said two ribs are joined to said upright flange.

4. The golf club head of claim 1, wherein said counter weight element is secured in one of said transverse grooves.

5. The golf club head of claim 1, further comprising an additional counter weight element, wherein said peripheral wall has a thickness adjacent said bottom greater than a thickness adjacent said top, and said counter weight element and said additional counter weight element are respectively secured in said continuous groove.

6. A golf club head comprising a front, a back, a top, a bottom, a toe and a heel, said front having a club face with a uniform thickness and a periphery, said back including a peripheral wall extending backward from said periphery of said front at an angle; said peripheral wall extending about said top, said bottom, said toe and said heel; said back additionally including an upright flange extending backward at said angle and forming a continuous groove with said peripheral wall, said back further including a cavity formed by said upright flange; said club face, said peripheral wall and said flange are integrally formed; a counter weight element and an additional counter weight element are respectively secured in said continuous groove, and said continuous groove has a width gradually reducing from said bottom toward said top.

7. A golf club head comprising a front, a back, a top, a bottom, a toe and a heel, said front having a club face with a uniform thickness and a periphery, said back including a peripheral wall extending backward from said periphery of said front at an angle; said peripheral wall extending about said top, said bottom, said toe and said heel; said back additionally including an upright flange extending backward at said angle and forming a continuous groove with said peripheral wall, said back further including a cavity formed by said upright flange; said club face, said peripheral wall and said flange are integrally formed; a rear counter weight element and a front counter weight element, said front and rear counter weight elements are secured into said continuous groove by a bonding agent, said front and rear counter weight elements have a same weight but different shapes, said front and rear counter weight elements are marked with a respective code number, and said front and rear counter weight elements overlap with one end of said rear counter weight element attached to a center of said front counter weight element and with said code number of said rear counter weight element visible.

* * * * *